United States Patent [19]

Deininger

[11] 4,007,662

[45] Feb. 15, 1977

[54] AXIAL PISTON MACHINE OF OBLIQUE-AXLE CONSTRUCTION WITH TILTABLE CYLINDER DRUM

[75] Inventor: Horst Deininger, Ulm, Donau, Germany

[73] Assignee: Hydromatik GmbH, Ulm, Donau, Germany

[22] Filed: Jan. 2, 1976

[21] Appl. No.: 646,404

[30] Foreign Application Priority Data

Jan. 17, 1975 Germany ..... 2501867

[52] U.S. Cl. ..... 91/6.5; 91/504

[51] Int. Cl.[2] ..... F01B 13/04

[58] Field of Search ..... 91/499–507, 91/6.5

[56] References Cited

UNITED STATES PATENTS

| | | | |
|---|---|---|---|
| 2,967,491 | 1/1961 | Wiggermann | 91/499 |
| 3,915,069 | 10/1975 | Wagenseil et al. | 91/504 |

FOREIGN PATENTS OR APPLICATIONS

| | | | |
|---|---|---|---|
| 2,313,575 | 3/1973 | Germany | 91/504 |

*Primary Examiner*—William L. Freeh
*Attorney, Agent, or Firm*—Owen, Wickersham & Erickson

[57] ABSTRACT

An axial piston machine has a control mirror body with a cylinder drum adjustable in both directions from a middle position with zero speed stroke of the pistons. An orifice in a guide surface (which at a given time is connected with a suction duct and a pressure duct) is divided into a pair of orifices connected via connecting ducts with the respective duct. The pair of orifices are symmetrical in the direction of tilt of the mirror member with its middle position in the guide surface. The orifice of each pair which at a given time is located against a momentary tilting direction and not covered by the mirror member is disconnected by a closing device from the associated suction or pressure duct.

The constructively possible area of tilt of the mirror member and thereby of the cylinder drum is considerably enlarged. The control mirror member need not cover the entire pressure-side aperture of the guideway in every position of tilt. The invention has utilized the realization that in the middle position of the cylinder drum, that is, when the pistons do not carry out a stroke, neither does a conveyor current occur and that this results in an area in which all orifices in the guideway which lead to the suction and pressure duct may be closed simultaneously without disadvantage. In a practical embodiment of the invention the orifices of each pair of orifices in the guide surface are spaced from each other in the direction of tilt so that in the middle position (zero stroke position) of the control mirror member none of the orifices is connected with the ducts to the control ports in the mirror member.

6 Claims, 11 Drawing Figures

AXIAL PISTON MACHINE OF OBLIQUE-AXLE CONSTRUCTION WITH TILTABLE CYLINDER DRUM

BACKGROUND OF THE INVENTION

The invention relates to an axial piston machine of the kind having an oblique-axle construction with a tiltable cylinder drum and a drive-connected drive pulley stationarily supported in a casing, pistons movable in cylinder bores of the drum being articulated to the drive pulley via ball-and-socket joints and with a control mirror member with control ports (reniform) which face the outlets of the cylinder bores, a cylindrical backside of the mirror member facing away from the control mirror being supported on a suitably shaped guide surface of the casing, and the control mirror member being tiltable by an adjusting device which tilts the cylinder drum, in order to adjust the stroke of the engine, and the bearing surface being provided with orifices connected with suction and pressure ducts for the pressure medium, which orifices are connected with the control ports via conduits penetrating through the control mirror member.

These types of axial piston machines have become known, for example from the published German Patent Application No. 1,017,468. They are particularly suitable for small-scale closed drives and excell by a noiseless and low-vibration running even at high pressures and speeds.

The cylinder drum is rotatably mounted on the control mirror member and is supported by the latter, the back side of the mirror member facing away from the control mirror on the mirror member being supported on the cylindrical slideway in the pump housing. This per se advantageous basic concept, however, causes difficulties for the admission and evacuation of the conveying medium, since the admission and evacuation of the conveying medium to the cylinder bores must proceed from the suction or pressure ducts in the pump housing through the control mirror member, and this passage of the medium must occur during all positions of tilt of the cylinder drum and of the control mirror member.

For these reasons, the angle of tilt of all hitherto known machines is limited in that, on the pressure-feeding side, the slots or orifices for passing the pressure medium through the control mirror member and the orifice of the pressure duct in the guide surface in the pump housing must overlap over the entire area of tilt of the control mirror member, and the pressure duct in the pump housing must at all times be covered up and sealed by the control mirror member against the interior of the pump housing. Further, the size of the apertures in the mirror member may only be such that the compression forces acting on the mirror member and the surrounding sealing surfaces will not lift the mirror member off its slideway. The angle of tilt still possible due to these limitations is not sufficient for meaningfully utilizing such a machine also in reverse drive. In other words, it is impossible with pumps of this species to tilt the mirror member with cylinder drum from a middle position with zero stroke for the pistons within the cylinder drum in two directions, so that, when the direction of rotation is maintained, the direction of feed of the pressure medium is reversed at the drive shaft, that is, a transposition of pressure and suction duct takes place.

SUMMARY OF THE INVENTION

The underlying object of the invention is to constructively further develop an axial piston machine of the above-mentioned type, that it is usable in reverse drive, with reversal of the direction of feed.

To solve this problem, it is proposed in accordance with the invention in connection with an axial piston machine of the above-mentioned type, that the control mirror body with the cylinder drum be adjustable in both directions from a middle position with zero speed stroke of the pistons and that the orifice in the guide surface which at a given time is connected with the suction duct and the pressure duct is divided into a pair of orifices connected via connecting ducts with the respective duct, the pair of orifices being symmetrical in the direction of tilt of the mirror member with its middle position in the guide surface, and that the orifice of each pair which at a given time is located against a momentary tilting direction and not covered by the mirror member is disconnected by a closing device from the associated suction or pressure duct.

It is thereby achieved that the constructively possible area of tilt of the mirror member and thereby of the cylinder drum is considerably enlarged. The control mirror member need not cover the entire pressure-side aperture of the guideway in every position of tilt. The invention has utilized the realization that in the middle position of the cylinder drum, that is, when the pistons do not carry out a stroke, neither does a conveyor current occur and that this results in an area in which all orifices in the guideway which lead to the suction and pressure duct, may be closed simultaneously without disadvantage. In practical embodiment of the invention the orifices of each pair of orifices in the guide surface are spaced from each other in the direction of tilt so that in the middle position (zero stroke position) of the control mirror member none of the orifices are connected with the ducts to the control ports in the mirror member.

By specific closing devices (described in detail in the description of this application) and their specific configuration in coupling with the adjustment device for the control mirror member, it is achieved in simple manner that the revealed passage cross-section between the passage ducts in the control mirror cradle and the orifices in the guide surface increase proportionally to the conveying current. Thus the speed of flow of the pressure medium remains constant up to the complete opening of the respective duct in the casing. In turn, this again ensures that, when the pump is reversed and the middle position (zero stroke position) is passed, the closing devices need not suddenly close or open the ducts under full load.

Embodiments of the invention will now be more particularly described with reference to the accompanying drawings.

DESCRIPTION OF THE PREFERRED EMBODIMENTS

Figure 1:
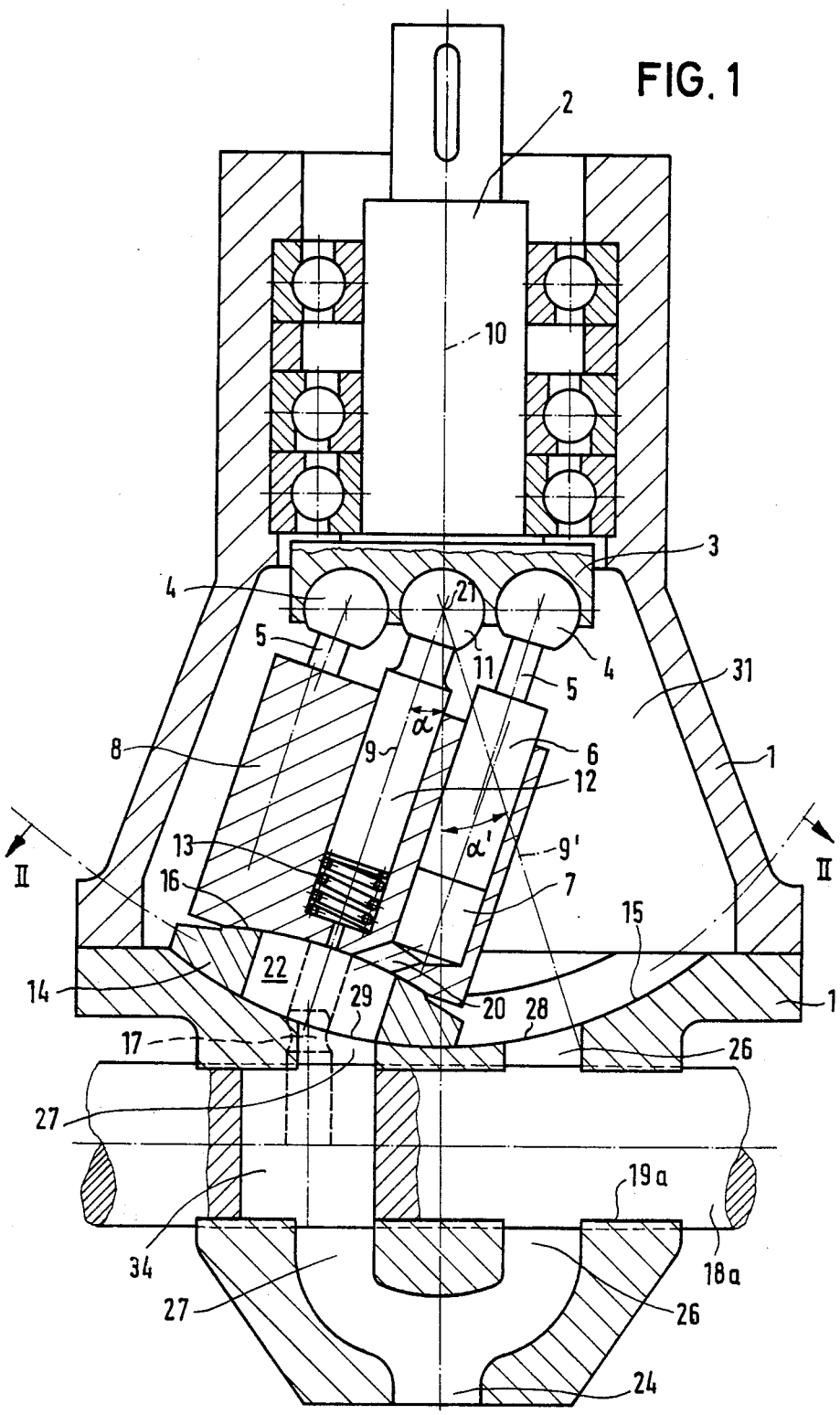
FIG. 1 shows schematically a cross-section through an axial piston machine in accordance with the invention in the plane of tilt (I—I in FIG. 5) with the cylinder drum maximally tilted to one side.
Figure 2:
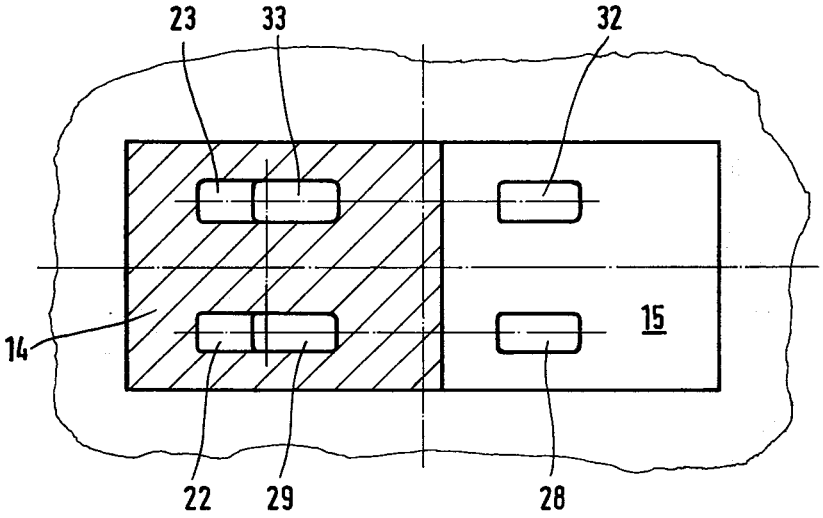
FIG. 2 shows a cut-out of a sectional view seen along line II—II in FIG. 1.
Figure 4:
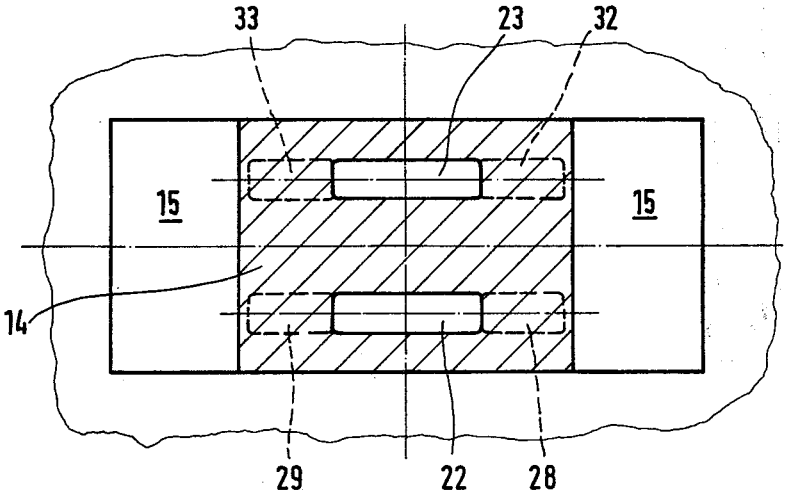
FIG. 4 shows in cut-out a sectional view seen along the line IV—IV in FIG. 3.

The parts of the axial piston machine which are identical or functionally equal in all embodiments in accordance with the attached drawings are at first described jointly and are indicated by the same reference numerals in all figures. Where there is substantial deviation in the configuration of a part, this part is provided for the individual embodiment with the additional letters *a*, *b* or *c*.

The axial piston machine illustrated in the drawings has a drive shaft 2 supported in a housing 1 which for the practical purpose of constructing the machine is made of two parts; the drive shaft 2 integrally carrying a drive plate 3. On the drive plate 3, the piston rods 5 of pistons 6 are supported via ball-and-socket joints 4. The pistons 6 move in cylinder bores 7 of a cylinder drum 8. The cylinder drum 8 is set in rotational motion by the drive shaft 2 via the drive plate 3 and the pistons 6. The stroke of the pistons 7 depends on the oblique angle $\alpha$ of the cylinder drum axle 9 to the rotational axis 10 of the drive shaft 2. The cylinder drum is centered by a central lug 12 supported via a ball 11 on the drive plate 3 and is supported on a control mirror member 14 — under the action of the compression forces of the pressure medium in the cylinder bores 7 when in loaded condition, and only under the force of the compression spring 13 provided between the lug 12 and the cylinder drum 8 when the machine is in loaded condition. The control mirror member 14 in turn is supported on a cylindrical slideway 15 of the lower part of the housing 1. To alter the oblique angle $\alpha$ of the axle 9 of the cylinder drum 8 in relation to the shaft axis 10 and thereby alteration of the stroke volume of the piston 6 in the cylinder bores 7, an adjustment lug 17 which is fixedly disposed in an adjustment rod 18*a* (FIGS. 1–5), 18*b* (FIGS. 6–8), 18*c* (FIGS. 9, 10) engages the control mirror member 14. The adjustment rod 18*a*, *b*, *c* is movably supported in the lower part of the machine casing 1 in a bore 19*a*, 19*b*, 19*c*. The parts 17 and 18*a*, *b*, *c* form the adjustment device for the tilting of the cylinder drum 8. An adjustment mechanism (not shown) engages the adjustment rod 18*a*, *b*, *c*, for moving the adjustment rod 18*a*, *b*, *c* in its longitudinal direction in the casing 1, so that the adjustment lug 17 displaces the control mirror member 14 in the cylindrical guide surface 15 while tilting the cylinder drum 8 about the axis of tilt 21.

In the control mirror member 14, on the mirror surface 16 facing the cylinder drum 8, connecting conduits 22 and 23 (FIG. 5) terminating in control ports (reniform) (not shown) are provided, which connect the outlets 20 of the cylinder bores 7 in the cylinder drum 8 with the suction conduit 24 and pressure conduit 25 respectively in the lower part of the casing 1 of the machine. Which of the conduits 24 and 25 is the suction conduit or pressure conduit or vice versa depends on the direction of rotation of the drive shaft 2 driven by a driving engine (not shown) and on what side the cylinder drum 8 is tilted by the adjustment device 17, 18*a*, *b*, *c* from the zero stroke position shown in FIG. 3.

The conduit 24 here indicated as the suction conduit is divided within the lower part of the housing 1 in connecting conduits 26 and 27 which terminate in the guide surface 15 in a pair of pressure orifices 28, 29. The connecting conduit 22 in the control mirror member 14 is aligned, as will be described in greater detail hereinbelow, depending on the direction of tilt of the mirror member 14 with the cylinder drum 8, either with the orifice 28 or with the orifice 29 for connecting the cylinder bores 7 with the suction conduit 24.

Figure 5:
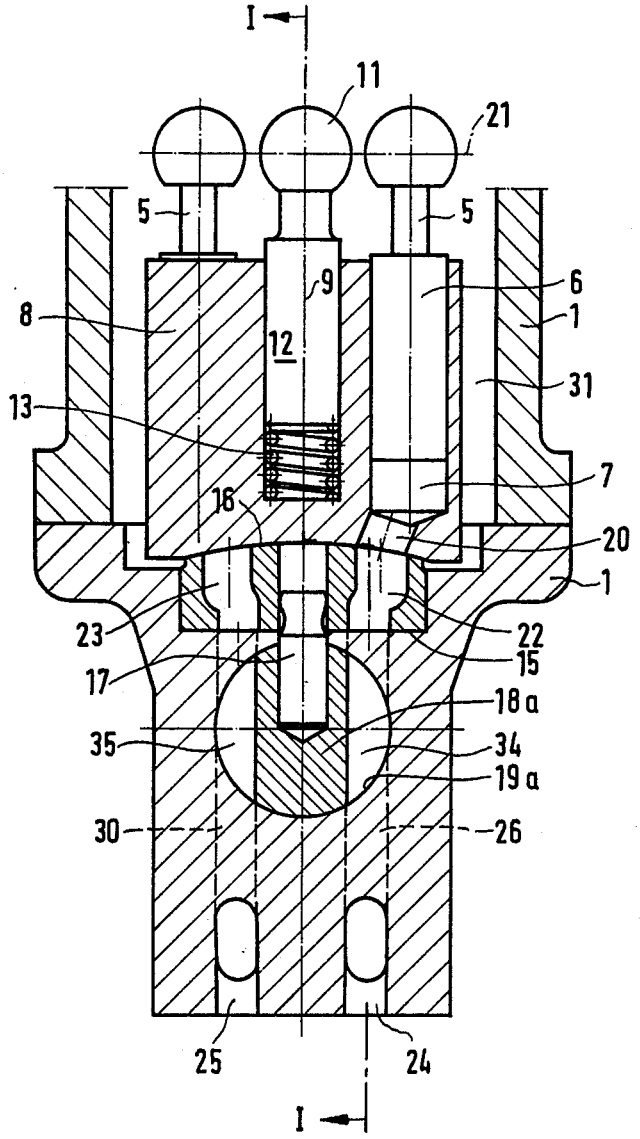
FIG. 5 is a sectional view along line V—V in FIG. 3.

Correspondingly, conduit 25 which is here designated as the pressure conduit is divided in the lower part of the casing 1 into connecting conduits (of these, the connecting conduit 30 is indirectly visible only in FIG. 5) which terminate in a pair of orifices 32, 33 (FIG. 2) connected with a pressure conduit 25. Depending on the position of tilt of the control mirror member 14 with the cylinder drum 8, either the orifice 32 is aligned with the connecting conduit 23 in the mirror member or the orifice 33, and produces the connection between the cylinder bores 7 and the pressure conduit 25.

Since, depending on the position of tilt of the control mirror member 14 with the cylinder drum 8, one of the orifices 28 or 29 and 32 or 33 of the orifice pairs 28, 29 and 32, 33 respectively, are not covered by the control mirror member 14, that is, are open towards the interior 31 of the machine casing 1, there are provided within the connecting conduits 26, 27, 30, between the suction conduit 24 and the orifices 28, 29 or the pressure conduit 25 and the apertures 32, 33, closing devices which close the respective connecting conduits.

In the embodiment in accordance with FIG. 1, 3, 5, the bore 19*a* in the lower part of the casing 1 for the adjustment rod 18a is so large that it also penetrates through the connecting conduits 26, 27, 30, 31. The adjustment rod 18*a* is correspondingly enlarged in cross-section so that it fills the bore 19*a* and forms a control valve which, as will be seen in FIG. 5, is provided on two opposite sides with recesses 34, 35, respectively. Depending on the position of the adjustment rod 18*a*, the recesses 34 and 35 clear one of the connecting conduits 26, 27 of the suction conduit 24 and one of the connecting conduits of the pressure conduit 25, while the other connecting conduit is closed by the adjustment rod 18*a*.

Figure 6:
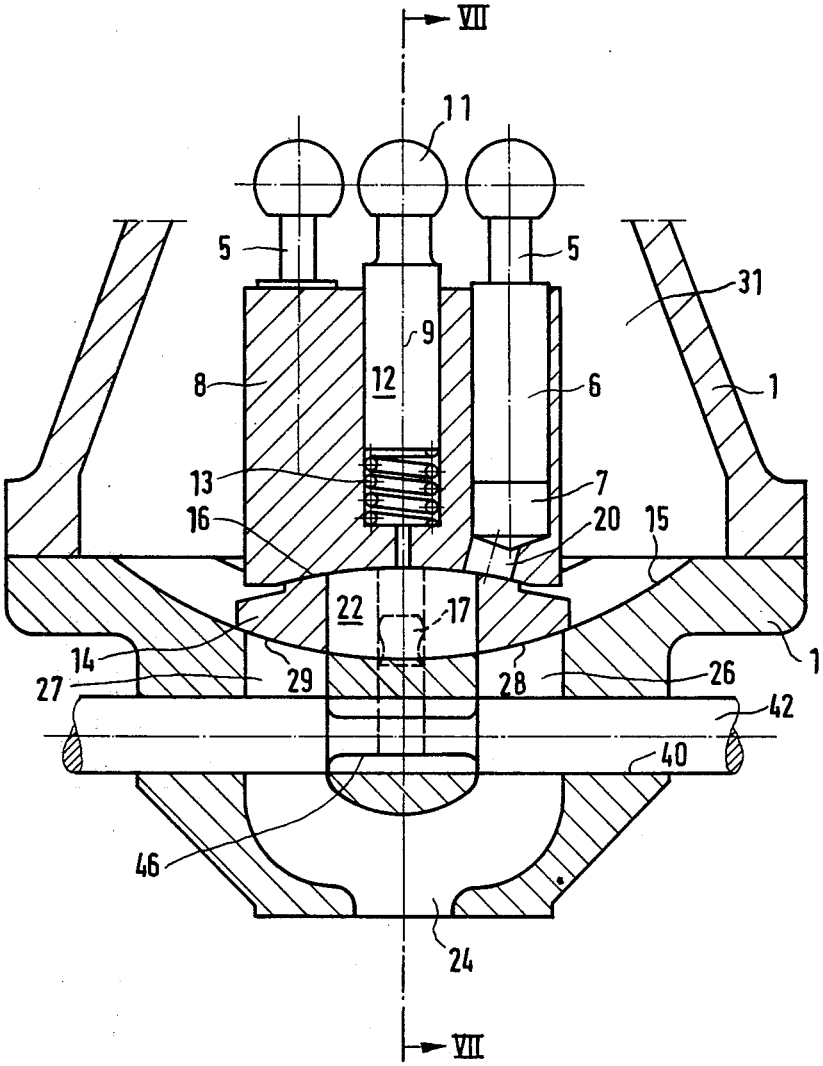
FIG. 6 is a cut-out of a sectional view corresponding to FIG. 3 of a further embodiment.
Figure 7:
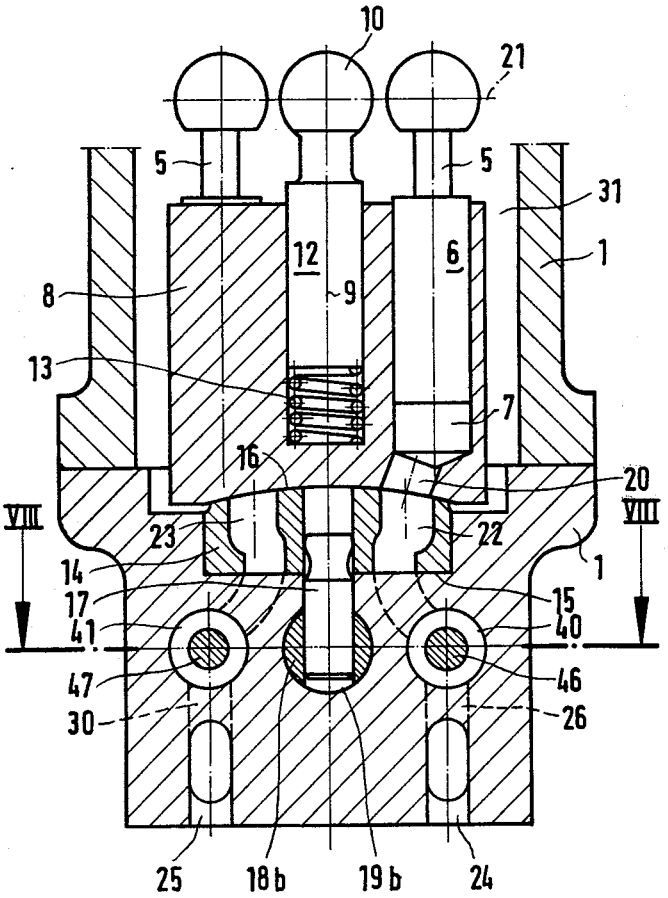
FIG. 7 is a sectional view along line VII—VII in FIG. 6.
Figure 8:
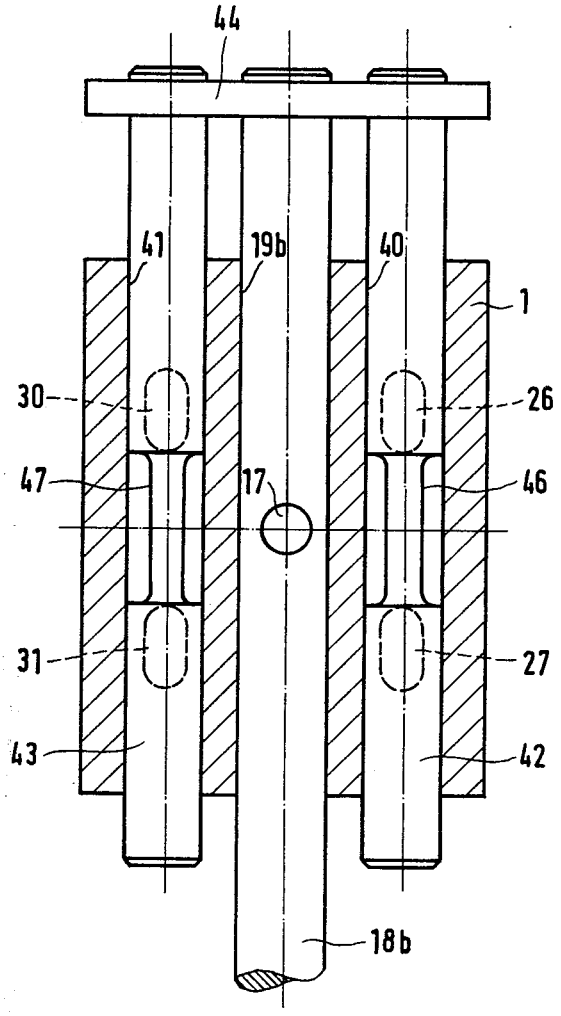
FIG. 8 is a sectional view along line VIII—VIII in FIG. 7.

In the embodiment in accordance with FIGS. 6–8, there are provided within the lower part of the casing 1 parallel to the bore 19*b* for the control rod 18*a*, bores 40 and 41 which penetrate through the pairs of connecting conduits 26, 27 and 30, 31, respectively. Within the bores 40, 41, control valves 42, 43 are movably disposed and fixedly connected with the adjustment rod 18*b* via a yoke 44 (see FIG. 8). Each of the control valves 42, 43 has an area 46, 47 in the form of a recess extending over its entire circumference and reduced in relation to the cross-section of the valve 42, 43. Depending on the position of the adjustment rod 18*b* and thereby the position of tilt of the mirror member 14, the control valves 42, 43 of one of the connecting conduits 26 or 27 and 30 or 31 of each pair of connecting conduits of the suction conduit 24 or pressure conduit 25, which control valves are coupled with the adjustment rod 18*b*, are freed by the area 46 and 47 which is reduced in cross-section, and the respective other connecting conduit is closed.

Figure 9:
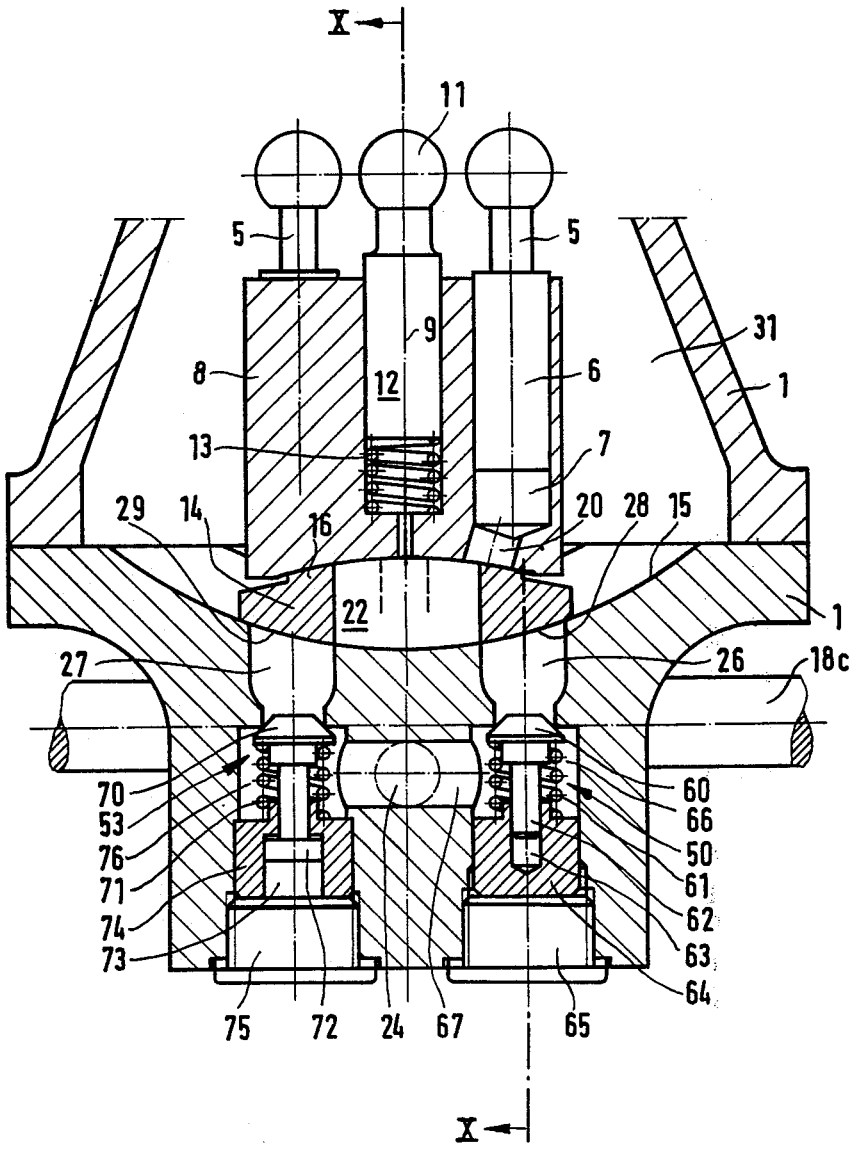
FIG. 9 is a cut-out of a sectional view corresponding to FIG. 3 of a third embodiment.
Figure 10:
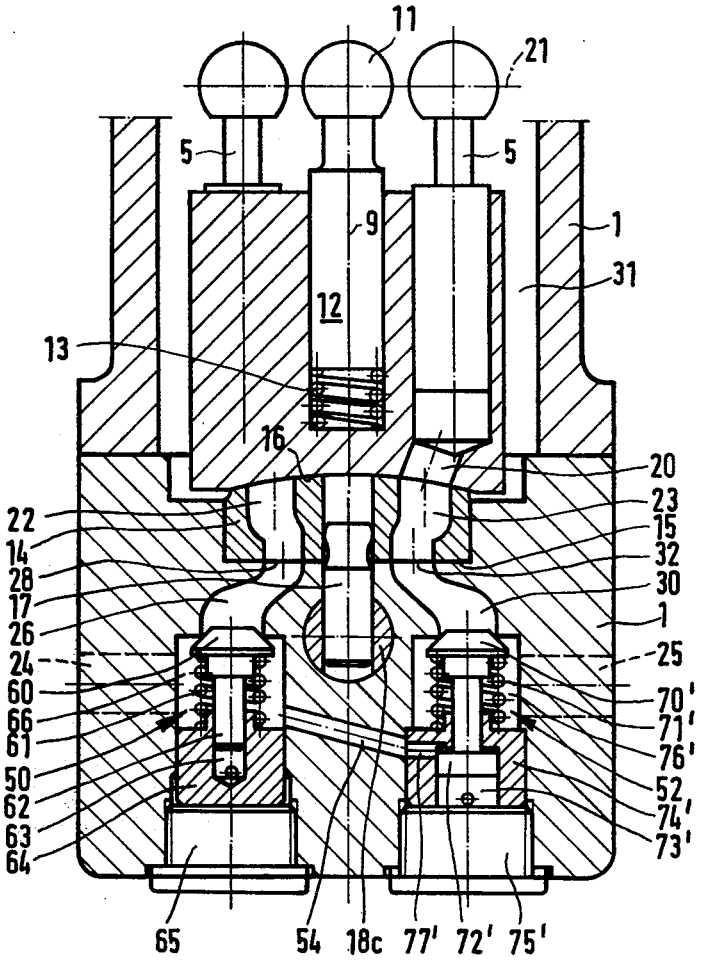
FIG. 10 is a sectional view along line X—X in FIG. 9.
Figure 11:
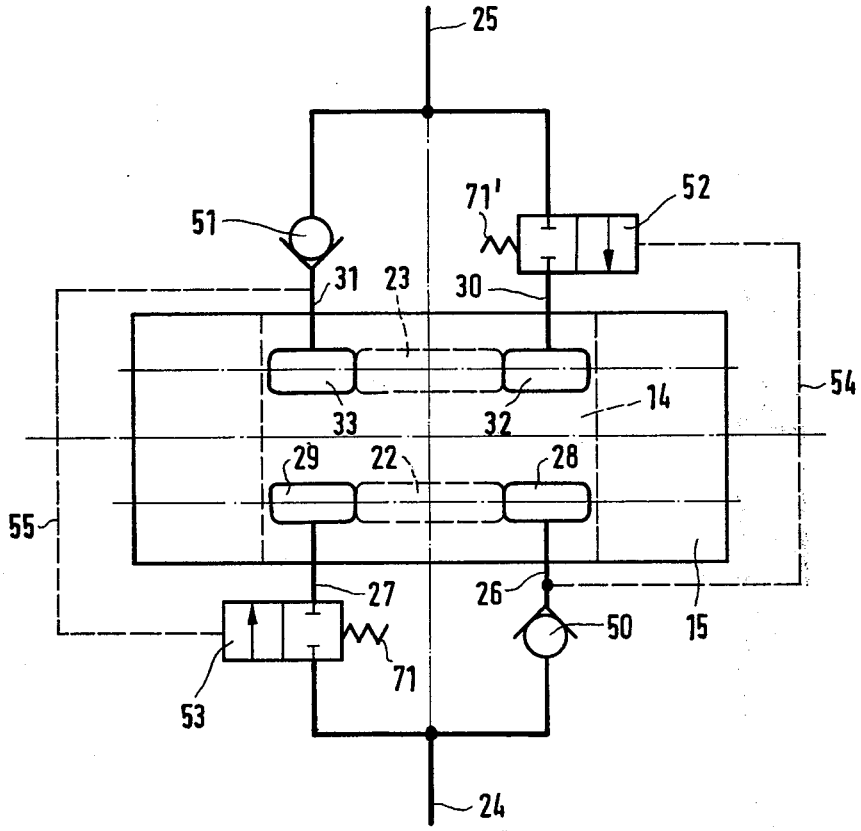
FIG. 11 is a function diagram of the embodiment in accordance with FIGS. 9 and 10.

In the embodiment in accordance with FIGS. 9 and 10, whose function diagram is represented in FIG. 11, release of a connecting conduit of each pair of connecting conduits and closing of the other connecting conduit of each pair is effected by valve devices independently of the adjustment device, that is, the adjustment rod 18*c*. For better understanding, the arrangement of the valve devices is at first explained in connection with the schematic representation of FIG. 11, which in its central portion shows a top view of the guide surface 15 corresponding to FIG. 4. The pair of orifices 28, 29 is connected with the conduit 24 designated as the suction conduit, via the connecting conduit 26, 27. The pair of orifices 32, 33 in the guide surface 15 is connected with the conduit 25 designated as a pressure conduit, via the connecting conduit 30, 31. A connecting conduit 26 or 31 of the connecting conduits associated with each pair of orifices 28, 29 and 32, 33, respectively, contains as the valve arrangement check valve 50 or 51 closing toward the associated orifice 28 and 33, respectively. The respective other connecting conduit 27 or 30 of each pair of orifices 28, 29 and 32, 33, respectively, contains as the valve arrangement a balanced pilot valve 52 and 53, respectively. The pilot valves 52 and 53 are connected via a control conduit 54 and 55, respectively, with the connecting conduit 26 and 31, respectively, containing the check valve 50 and 51, respectively, of the respective other pair of orifices 28, 29 and 32, 33, respectively, in the guide surface 15. The pilot valves 52, 53 have two positions. In one position, the respective connecting conduit 27 or 30 is closed under the pressure of the spring 71' of the valve 52 and spring 71 of the valve 53, respectively. In the other position, the connecting conduits 27 and 30, respectively, are opened when the pressure prevailing in the respective control conduit 55 or 54 opens the pilot valve 23 against the pressure of the spring 57 or the pilot valve 52 against the pressure of the spring 56. In connection with the diagram in accordance with FIG. 11, the structural arrangement of the valve devices in FIGS. 9 and 10 becomes understandable. Parts having the identical function are designated with the same reference numeral. The check valve 50 in the connecting conduit 26 and correspondingly the check valve 51, not shown in FIGS. 9 and 10, is of known construction and comprises a closing member 60 which closingly engages, under the pressure of a spring 61, a valve seat formed in the conduit 26. A guide rod 62 of the closing member 60 is guided in a bore 63 inside a plug 64. The plug 64 is inserted in a bore of the lower part of the casing 1 and is held by a closing screw 65. The valve chamber 66 formed inside the bore of the casing 1 behind the plug 64 is connected, via a lateral bore 67, with the suction conduit 24 and the valve chamber 76 of the pilot valve 53 in the connecting conduit 27 of the same pair of orifices 28, 29. The pilot valve 53 comprises a valve body 70 which, when the valve is in closed position, abuts against a valve seat in the connecting conduit 27 under the pressure of a spring 71 and closes the connecting duct 27 in relation to the valve chamber 76 and thereby to the suction conduit 24. The spring 71 is supported on a plug 74 which is inserted in a bore in the lower part of the casing 1 and is held by a closing screw 75. Within the plug 74, a cylinder chamber 73 is formed in which a part of the valve body 70 is guided as a control piston 72. The pilot valve 52 in the connection duct 30 seen in FIG. 10 is constructed corresponding to the control valve 53 and the corresponding parts are designated with the reference numerals 70' to 76'. However, it is seen in FIG. 10 that the upper part of the cylinder chamber 73' in the plug 74' is connected by a bore 77' with a control conduit 54 penetrating through the lower part of the casing 1, the other side of the control duct 54 terminating in the valve chamber 66 of the check valve 50.

When the check valve 50 is opened under the pressure in the connecting conduit 26, then the valve chamber 76 is under pressure, and this pressure is passed on through the control duct 54 onto the upper face of the control piston 72', so that the latter's valve body 70' moves downwardly against the pressure of the spring 71' and opens the connecting conduit 30 and connects it with the suction conduit 25. Correspondingly, in accordance with FIG. 9 the upper part of the cylinder chamber 73 in the plug 74 of the pilot valve 53 is connected, via a control conduit 55, not seen in FIG. 9, with the valve chamber of the check valve 51, not seen, in the connecting duct 31, and opens the pilot valve when the check valve 51 opens. This will be understood from FIG. 11.

The mode of operation of the axial piston machine in accordance with the invention is as follows:

As is known, an axial piston machine may operate as a pump as well as a motor. For simplicity's sake, it is assumed in connection with the description which follows, that the axial piston machine operates as a pump. The drive shaft 2 is made to rotate by a driving machine, not shown, and correspondingly, the cylinder drum 8 is rotated by entrainment via the drive plate 3 and the piston rods 5 and pistons 6. If the oblique angle between the axle of rotation 9 of the cylinder drum 8 and the axis 10 of the drive shaft 2 is zero, according to FIGS. 3, 6 and 9, then the pistons 6 do not execute a stroke in the cylinder chambers 7 of the cylinder drum 8, and no medium is conveyed. If the adjustment rod 18*a, b* or *c* is moved to one side by actuation of the adjustment mechanism, not shown, then the adjustment pin 17 entrains the control mirror member 14 in the corresponding direction, and the cylinder drum 8 is tilted with its axis 9 by a finite value of the angle of tilt $\alpha$ in relation to the axis 10 of the shaft 2. The greater the value of the angle of tilt that is, the oblique position of the cylinder drum 8, the greater is the stroke executed by the pistons 6 in the cylinder bores 7 in the cylinder drum 8 and thereby the amount of medium supplied by the pump. It is assumed that, corresponding to the rotational direction of the shaft 2 and thereby of the cylinder drum and the angle of tilt $\alpha$ adjusted in FIG. 1, the medium is sucked in through the conduit 22 in the control mirror member 14, the orifice 29, the connecting duct 27 and the conduit 24. The conduit 24 is thus the suction conduit. Correspondingly, according to FIGS. 2 and 5, the duct 25 is the pressure conduit which connected via the connecting conduit 31 (not shown), the orifice 33 and the conduit 23, with the outlets 20 of the cylinder bores 7 which deliver the medium under pressure. Since, by displacement of the adjustment rod 18*a* to the left, in accordance with FIG. 1, the recesses 34 clear the connecting conduits 27 and the connecting conduit 31 (not shown), the pump can operate. The orifices 28 and 32 which in this direction of tilt are not covered by the control mirror member 14, and the associated connecting ducts 26 and 30 are closed by the cross-section of the adjustment rod 18*a* which completely fills the bore 19*a*, so that no medium can reach, particularly out of the pressure conduit 25, into the inner chamber 31 of the pump housing 31.

Figure 3:
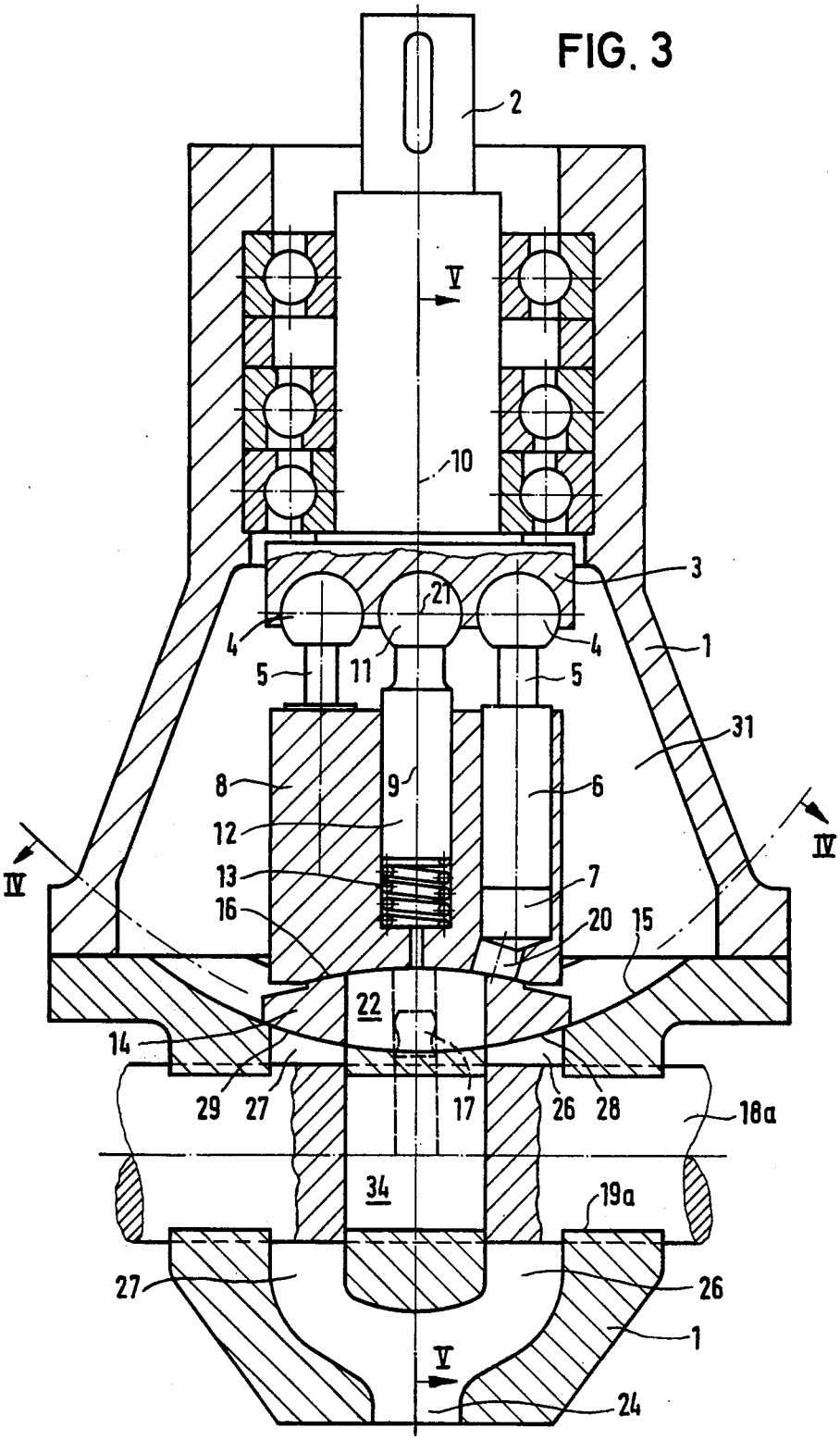
FIG. 3 shows schematically a cross-section of the machine corresponding to FIG. 1 in middle position (zero stroke position) of the cylinder drum.

When the adjustment rod 18*a* is moved to the right by an adjustment mechanism (not shown) according to FIGS. 1 and 3, and the cylinder drum 8 thereby changes from a zero stroke position shown in FIG. 3 into a tilted position with an oblique angle $\alpha'$, so that the axis of rotation of the cylinder drum 8 arrives into the position 9' indicated in FIG. 1, then the control mirror member 14 covers the orifices 28 and 32, and the orifices 29 and 33 are no longer covered. While retaining the previously assumed rotational direction of the shaft 2 and thereby of the cylinder drum 8, the suction side of the pump is formed via the conduit 23, the orifice 32, the connecting duct 31 (not shown) and the conduit 25, that is, the conduit 25 is a suction conduit. The pressure side of the pump is formed by the conduit 22, the orifice 28, the connecting duct 26 and the conduit 24, that is, the conduit 24 is now the pressure conduit. The connecting conduits 26 and 30 which are required in this direction of tilt (angle of tilt $\alpha'$) are then opened by the recesses 34 in the adjustment rod 18*a*, and the connecting conduits 27 and the conduit 31, not shown, are closed by the cross-section of the adjustment rod 18*a* which completely fills the bore 19*a*, so that no pressure medium can get from the pressure conduit 24 into the inner chamber 31 of the pump casing 1 via the connecting duct 27 and the orifice 29 which is not covered by the control mirror member 14. It is only in the zero stroke position of the cylinder drum 8 seen in FIGS. 3, 6 and 9 that both pairs of orifices 28, 29 and 32, 33 in the guide surface 15 are closed by the control mirror member 14. This is admissible, since no medium is being conveyed in the zero stroke position.

The mode of operation of the embodiment according to FIGS. 6–8 corresponds to the mode of operation of the above-described embodiment according to FIGS. 1–5. There is merely a structural difference in the control device for closing the connecting ducts 26, 27 and 30, 31 associated with the pairs of orifices 28, 29 and 32, 33 respectively. The function of the recesses 34 in the adjustment rod 18*a* is assumed in the embodiment in accordance with FIGS. 6–8 by the areas 46 and 47, tapering in cross-section, of the control valves 42 and 43 which are coupled with the adjustment rod 18*b* via the yoke 44. It is further common to the embodiment according to FIGS. 1–5 and the embodiment according to FIGS. 6–8, that the control for opening and closing the connecting ducts associated with the pairs of orifices 28, 29 and 32, 33 occurs mechanically with the tilting of the cylinder drum 8. This has the additional advantage that, by tilting the cylinder drum 8 to larger angles of tilt $\alpha$ and $\alpha'$, respectively, and thereby to larger amounts of flow, the passage cross-sections in the pressure and suction-side connecting conduits are opened by the recesses 34 of the areas 46 and 47 in the embodiment of FIGS. 6–8, proportionally to the flow of medium which increases due to the increasing angle of tilt $\alpha$ and $\alpha'$, respectively, so that, until the respective connecting duct is fully opened, the speed of flow of the medium remains constant.

The embodiment in accordance with FIGS. 9–11 operates, as to the control, that is, closing and opening of the connecting conduits to the pairs of apertures 28, 29 and 32, 33, according to a different principle. There, the connecting ducts are not opened and closed mechanically as a function of the adjustment device for adjusting the oblique angles $\alpha$ and $\alpha'$ of the pump, but automatically as a function of the direction of flow of the medium, by a suitable construction of the valve devices 50–53 disposed in the connecting conduits. If it is again assumed that, given the direction of tilt of the cylinder drum 8 and thereby of the control mirror member 14 into a position in which the mirror member 14 covers the orifices 29 and 33, but the orifices 28 and 32 are opened, the orifice 29 is the suction-side orifice and the orifice 33 is the pressure-side orifice, then, as is seen in FIG. 11, the check valve 51 opens and frees the connection to the pressure conduit 25. Simultaneously, the pressure prevailing in the control conduit 25 opens the pilot valve 53 and releases the connecting duct 27, so that the suction-side orifice 29 is connected with the suction conduit 24. The check valve 50 which is associated with the orifice 28 not covered by the mirror member 14, and the pilot valve 52 which is associated with the orifice 32 which is not covered by the mirror member 14 either, remain closed, so that there is no connection between the suction conduit 24 or pressure duct 25 and the inner chamber 31 of the pump casing 1. When the mirror member 14 and thereby the cylinder drum 8 are tilted in the opposite direction, the orifice 28 of the pair of orifices 28, 29 is the pressure-side orifice, and the orifice 32 of the pair of orifices 32, 33 is the suction-side orifice. The check valve 50 then releases the connecting conduit 26 to the pressure conduit 24, and the pilot valve 52 is opened by the pressure admitted to the control conduit 54 and releases the connecting duct 30 as a connection between the orifice 32 and the suction conduit 25. The valves 51 and 53 associated with the orifices 29 and 33 which are not covered by the mirror member 14 remain closed.

It should be pointed out that in the last-described embodiment and the described construction of the valves, the axial piston machine can be operated only as a pump. If the axial piston machine is to be operated as a motor, a different construction and arrangement of the valves would be necessary. The embodiments in accordance with FIGS. 1–5 and 6–8, on the other hand, operate in the described manner regardless of whether the axial piston machine is operated as a pump or as a motor.

I claim:

1. An axial piston machine of the kind having an oblique-axle construction with tiltable cylinder drum and drive-connected drive pulley stationarily supported in a casing, pistons movable in cylinder bores of the drum being articulated to the drive pulley via ball-and-socket joints and with a control mirror member with control ports which face the outlets of the cylinder bores, a cylindrical back side of the mirror member facing away from the control mirror being supported on a suitably shaped guide surface of the casing, and the control mirror member being tiltable by an adjusting device which tilts the cylinder drum in order to adjust the stroke of the engine, and the bearing surface being provided with orifices connected with suction and pressure ducts for the pressure medium, which orifices are connected with the control ports via conduits penetrating through the control mirror member, characterized in that the control mirror body with the cylinder drum is adjustable in both directions from a middle position with zero speed stroke of the pistons and that the orifice in the guide surface which at a given time is connected with the suction duct and the pressure duct is divided into a pair of orifices connected via connecting ducts with a respective one of the suction and pressure ducts, the pair of orifices being symmetrical in the direction of tilt of the mirror member with its middle position in the guide surface, and that the orifice of each pair which at a given time is located against a momentary tilting direction and not covered by the mirror member is disconnected by a closing device from the associated suction or pressure duct.

2. A machine as defined in claim 1 characterized in that the orifices of each pair of orifices in the guide surface are spaced from each other in the direction of tilt, so that in the middle position (zero stroke position) of the control mirror member, none of the orifices are connected with the ducts to the control ports in the mirror member.

3. A machine as defined in claim 1 characterized in that the closing devices for the orifices of each pair are formed in the guide surface by the adjustment rod of the adjustment device for tilting the control mirror member and wherein the cross-section of the adjustment rod inside the casing is enlarged to a control valve which passes through the connecting conduits of each pair of orifices to the suction and pressure conduits respectively and is provided with recesses which, depending on the position of the adjustment rod, open the connecting conduits of each pair of orifices.

4. A machine as defined in claim 1 characterized in that the closing devices comprise one of the control valves passing through the connecting conduits of the same pair of orifices, the control valve being provided with recesses which at a given time open one of the connecting conduits and is coupled with the adjustment device for tilting the control mirror member.

5. A machine as defined in claim 1 characterized in that the closure devices comprise valves disposed in the connecting conduits of each pair of orifices, the valve in the connecting duct of each pair whose one orifice, depending on the momentary direction of tilt of the control mirror member, is covered by the latter and is connected with the pressure conduit, is a check valve which opens in the direction toward the pressure conduit, and the valve in the connecting conduit of each pair, whose one orifice, depending on the momentary direction of tilt of the control mirror member, is covered by the latter and is connected with the suction conduit, is a balanced pilot valve.

6. A machine as defined in claim 5 characterized in that the balanced pilot valves are connected. via a control conduit with the connecting conduit, containing the check valve of the other pair of orifices, and open, against spring tension, its own connecting conduit when the connecting conduit of the other pair containing the check valve carries the pressure.

* * * * *